United States Patent [19]

Kruse et al.

[11] Patent Number: 4,471,495

[45] Date of Patent: Sep. 18, 1984

[54] PROTECTIVE GLOVE

[75] Inventors: Gary E. Kruse, Cranston, R.I.; Ross E. MacDonald, N. Attleboro, Mass.

[73] Assignee: Whiting and Davis Company, Inc., Plainville, Mass.

[21] Appl. No.: 458,136

[22] Filed: Jan. 14, 1983

[51] Int. Cl.[3] ..... A41D 19/00

[52] U.S. Cl. ..... 2/162; 2/167

[58] Field of Search ..... 2/161 R, 162, 167, 16; 140/1, 3 B, 88

[56] References Cited

U.S. PATENT DOCUMENTS

| | | | |
|---|---|---|---|
| 605,505 | 6/1898 | Murray | 2/161 R |
| 948,615 | 2/1910 | Pratt | 140/3 B |
| 1,010,199 | 11/1911 | Stedman | 2/162 |
| 1,028,904 | 6/1912 | Pratt | 140/3 B |
| 1,493,574 | 5/1924 | Sullivan | 2/162 |
| 1,655,295 | 1/1928 | Steinberger | 2/162 |
| 2,737,663 | 3/1956 | Harris | 2/161 R |
| 2,862,208 | 12/1958 | Castro | 2/161 P |

FOREIGN PATENT DOCUMENTS

| | | | |
|---|---|---|---|
| 2825525 | 1/1979 | Fed. Rep. of Germany | 2/161 R |
| 1162812 | 9/1958 | France | 2/162 |

*Primary Examiner*—Louis Rimrodt

[57] ABSTRACT

A metal mesh protective glove extending continuously around the user's hand and fingers. A continuous cuff extends around the circumference of the glove near the user's wrist and encloses a strap which is free to slide in and is removable from the cuff. The opposite ends of the strap extend from an opening in the cuff; and the strap includes means to secure its ends to each other to form a band of varying length so that the strap and cuff may be tightened about the wearer's wrist with minimum folding or drooping of the glove mesh.

12 Claims, 6 Drawing Figures

PROTECTIVE GLOVE

BACKGROUND OF THE INVENTION

This invention relates to safety gloves such as those worn by meat cutters.

Such gloves should be strong enough to prevent accidental injury to the wearer from knives and other meat cutting instruments. They should also resist absorption of fluids such as blood which could harbor bacteria, be able to withstand sterilizing temperatures, and avoid loose gathers or folds which could catch on machinery or otherwise interfere with work.

The gloves are made from a mesh of interlocking metal rings, typically bronze or stainless steel. Such meshes, and various methods of making them, have long been known in the art. See, for example, expired U.S. Pat. Nos. 948,615, 1,028,904. Because a wearer's hand is considerably larger in circumference than his wrist, and because also the interlocking ring construction does not permit the mesh to expand, existing mesh gloves include a side opening that extends from the wrist to near the base of the little finger. This side opening allows to glove to open and permits insertion of the user's hand. The glove is then held in place by a strap stitched to the end of the glove and buckled around the user's wrist.

This long-existing glove construction has several disadvantages. The side opening must be relatively long to permit the wearer's hand to be inserted; but a side opening is unsafe because it leaves a portion of the wearer's hand unprotected even when the glove is buckled in place. Further, the straps on such gloves easily become contaminated, rendering the glove unsanitary and therefore unfit for use in a meat cutting plant; yet because the strap must be stitched to the glove to draw the loose mesh on either side of the opening together and hold the glove in place, the strap cannot easily be replaced, and the entire glove often must be thrown away or returned to the manufacturer for a new strap long before any of the metal mesh has worn.

SUMMARY OF THE INVENTION

The invention features a metal mesh protective glove that has no side opening, but rather extends continuously around the user's hand. The strap used to buckle the glove in place is movably, and removably, contained in a cuff that also extends continuously around the circumference of the glove, adjacent the user's wrist. Such a continuous cuff, unlike spaced loops or similar supports, permits the strap to tighten the glove around the wearer's wrist without undesirable, and unsafe, folding or drooping of the gathered mesh.

Preferably, the cuff is at the open end of the glove and is made by folding a segment of mesh over on itself. The strap ends extend through a cuff opening on the back of the glove, and the mesh is comprised of interlocking rings having an inner diameter of between 3/32 and 3/16 of an inch.

DESCRIPTION OF THE PREFERRED EMBODIMENT

We turn now to a description of the preferred embodiment of the invention, first briefly describing the drawings thereof.

DRAWINGS

STRUCTURE AND OPERATION

Figure 1:
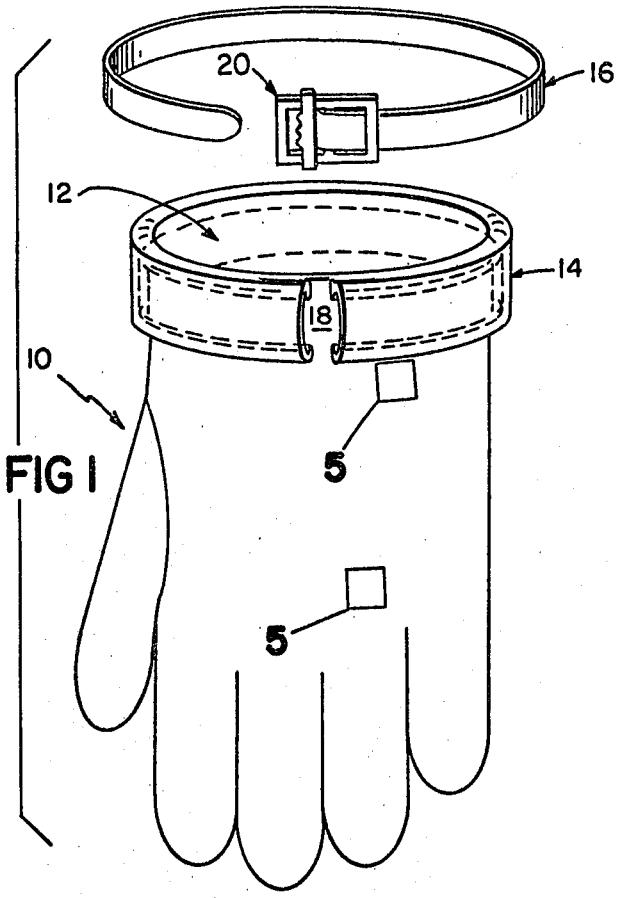
FIG. 1 is a perspective view of a glove according to the invention, with the strap removed.
Figure 5:
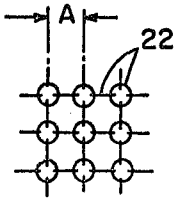
FIG. 5 is a view of a portion of the mesh of the glove as indicated on FIGS. 1 and 2.

FIG. 1 shows a protective glove 10 made from a mesh of interlocking stainless steel rings. The entire glove is made of interlocking mesh rings 22. The rings are more or less in two planes; in FIGS. 5 and 6, rings generally parallel to the overall glove surface are shown diagrammatically as circles, and interlocking rings perpendicular thereto are shown as lines. The mesh is continuous, without slits or gaps other than wrist opening 12. The circumference of the wrist opening 12 is about the same as that of the hand-encircling portion of the glove, and is large enough to permit the user's hand to be inserted through the wrist opening and into the glove. When the glove is laid flat, as shown in FIG. 2, the wrist opening is about as wide as the distance across the knuckles of the glove.

Figure 3:
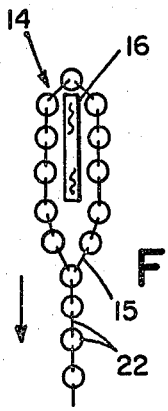
FIG. 3 is a diagrammatic cross-section along 3—3 of FIG. 2.

Wrist opening 12 is defined by a cuff 14, which extends continuously around the circumference of the wrist opening. As shown most clearly in FIG. 3, cuff 14 is formed by folding a segment of mesh back upon itself and then securing the edges of the mesh segment around the circumference of the body of the glove.

A nylon strap 16 is enclosed in cuff 12. The strap is not attached to the glove or cuff and is thus free to slide within and be removed from the cuff. Opposite ends of the strap 16 extend from an opening 18 in the cuff on the back of the glove and may be slidably secured to one another using a conventional buckle 20.

Figure 2:
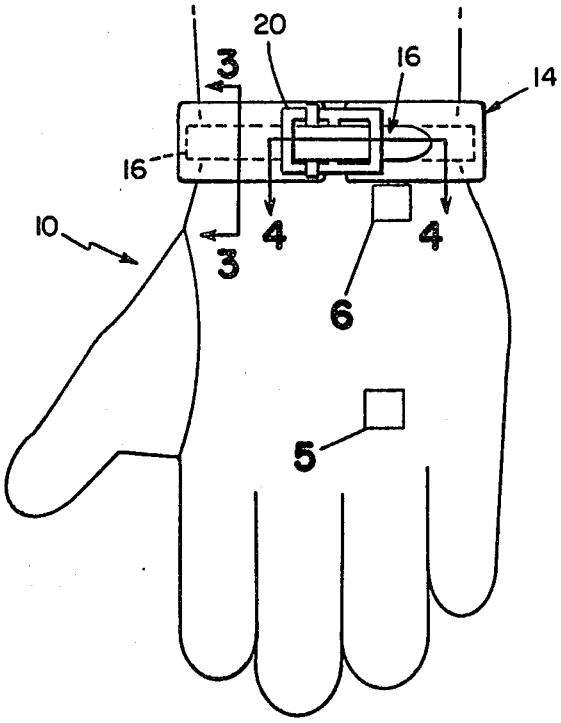
FIG. 2 is a plan view of the glove of FIG. 1 with a hand inserted therein.
Figure 4:
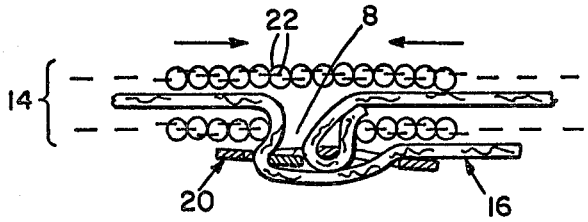
FIG. 4 is a diagrammatic cross-section along 4—4 of FIG. 2.
Figure 6:
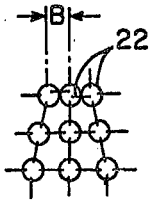
FIG. 6 is a view of a portion of the mesh of the glove as indicated in FIG. 2.

After the user's hand is inserted into the wrist opening, the strap is tightened around the wrist as shown in FIGS. 2 and 4. As will be apparent, and as indicated in FIGS. 4 and 6, the mesh adjacent the wrist is gathered (i.e., the steel rings are drawn together so that parallel rings overlap), as the strap is tightened. This gathering is necessary to reduce the overall circumference of the glove from the full hand width (see FIG. 5) to the smaller wrist width (see FIG. 6). Because the gathering takes place incrementally around the entire wrist opening, i.e., adjacent mesh rings are drawn together substantially continuously around the entire the wrist opening, there is little or no folding or drooping of the mesh. Specifically, the diameter of the mesh rings 22 is such that the difference between their center-to-center separation when expanded ("A" in FIG. 5) and their center-to-center separation when contracted ("B" in FIG. 6) is adequate, in the aggregate, to substantially accommodate the reduction in glove diameter necessary to tighten the glove around the wearer's wrist. To insure that this is accomplished, an inner ring diameter of between 3/32 and 3/16 of an inch is preferred. Any minor puckering of the mesh that results from this gathering is distributed evenly about the circumference of the wrist opening; and there is no drooping or other localized folding of mesh which would be distracting to the user and could constitute a safety hazard.

With the exception of the strap, the glove is entirely metal and may be subjected to sterilizing temperatures. Moreover, the strap is removable and replaceable so that, when it becomes contaminated, the old strap may be removed and a new strap put in its place by the user, without replacing the glove. Finally, the location of the strap buckle on the back of the hand is more convenient than earlier gloves with strap buckles located at the side opening.

OTHER EMBODIMENTS

Other embodiments are within the following claims. For example, the glove may be longer and extend some distance up the wearer's arm. For such embodiments, a continuous cuff at the wrist is provided by a layer of mesh fixed around the glove exterior adjacent the wrist. A first strap is movably and removably enclosed in that cuff; and a second strap is provided in a cuff at the opening end of the glove, similar to the wrist cuff described above for the preferred embodiment.

What I claim is:

1. In a protective glove of interlocking metal mesh including finger and thumb portions arranged to receive the fingers and thumb of a wearer, and a hand portion arranged to receive the hand of a wearer and to which said finger and thumb portions are attached, said hand portion including an opening through which the hand, fingers and thumb of the wearer may be inserted into the glove, that improvement wherein:

said hand portion is arranged to extend continuously around the hand of a wearer;

a cuff extends substantially continuously around the circumference of the glove on the side of said opening towards the finger and thumb portions and in position to surround the wrist of a wearer; and a strap is contained within and movable relative to said cuff, the end portions of said strap extending from within to without said cuff through at least one cuff opening, and said strap including means for adjustably connecting sad strap end portions to each other to form a continuous band of desired length whereby by tightening said strap the portion of said glove adjacent said cuff may be gathered about the wrist of a wearer of said glove.

2. The glove of claim 1 wherein said cuff is adjacent said opening of said glove.

3. The glove of claim 1 wherein said cuff is of said mesh.

4. The glove of claim 1 wherein said cuff is a segment of said mesh folded on itself.

5. The glove of claim 1 wherein said cuff opening is on the back of said glove.

6. The glove of claim 1 wherein said strap is removable from said cuff through said opening.

7. The glove of claim 1 wherein said mesh is comprised of interlocking rings having an inner diameter of between 3/32 and 3/16 of an inch.

8. In a protective glove including a glove body of interlocking metal mesh including finger and thumb portions arranged to receive the fingers and thumb of a wearer, and a hand portion arranged to receive the hand of the wearer and to which said finger and thumb portions are attached, said hand portion including an opening through which the hand, fingers and thumb of the wearer may be inserted into the glove, that improvement wherein:

said hand portion is arranged to extend continuously around the hand of a wearer;

a strap extends circumferentially around said glove body on the said of said opening towards the finger and hand portions in position to surround the wrist of a wearer and is movable relative to said glove body in a direction generally circumferential of said glove body; and, a layer of material overlies said strap and extends substantially continuously around the circumference of said glove, said layer being attached to underlying portions of said glove body along the opposite circumferential sides of said strap and the end portions of said strap extending from between said underlying portions of said glove body and said layer through at least one opening in said layer whereby by tightening said strap the portion of said glove adjacent said layer may be gathered about the wrist of a wearer of said glove.

9. The glove of claim 8 wherein said layer is a portion of said glove body folded back on itself.

10. The glove of claim 8 wherein said layer is of said mesh.

11. The glove of claim 8 wherein said strap is adjacent said opening of said glove.

12. The glove of claim 8 wherein said strap is removable from said glove body through said opening.

* * * * *